US005730588A

United States Patent [19]

Terai et al.

[11] Patent Number: 5,730,588

[45] Date of Patent: Mar. 24, 1998

[54] SCROLL COMPRESSOR HAVING A FIXED SCROLL PLATE WITH GROOVE

[75] Inventors: Toshiyuki Terai, Tochigi; Koichi Inaba; Koichi Sekiguchi, both of Shimotsuga-gun; Atushi Shimada, Tochigi, all of Japan

[73] Assignee: Hitachi, Ltd., Japan

[21] Appl. No.: 665,850

[22] Filed: Jun. 19, 1996

[30] Foreign Application Priority Data

Jun. 19, 1995 [JP] Japan ..... 7-151300

[51] Int. Cl.[6] ..... F04C 18/04; F04C 29/02

[52] U.S. Cl. ..... 418/55.2; 418/55.6

[58] Field of Search ..... 418/55.2, 55.6

[56] References Cited

U.S. PATENT DOCUMENTS 5,435,707 7/1995 Hirano et al. ..... 418/55.2

5,584,677 12/1996 Ishikawa et al. ..... 418/55.2

FOREIGN PATENT DOCUMENTS 5-202866 8/1993 Japan .

*Primary Examiner*—John J. Vrablik

*Attorney, Agent, or Firm*—Evenson, McKeown, Edwards & Lenahan, P.L.L.C.

[57] ABSTRACT

In a scroll compressor, a groove is provided on a sliding face with a rotating scroll plate, of a fixed scroll plate, the periphery corner of the orbiting scroll plate rotates in a range between a position inner than the periphery side corner of the groove and the sliding face locating inner side than the internal circumference side corner of the groove.

2 Claims, 10 Drawing Sheets

SCROLL COMPRESSOR HAVING A FIXED SCROLL PLATE WITH GROOVE

BACKGROUND OF THE INVENTION

The present invention relates to a scroll compressor and, more particularly, to a scroll compressor applied to an air-conditioner or a refrigerating apparatus.

A conventional scroll compressor will be described with reference to FIGS. 6 to 9. FIG. 6 shows the relation between a orbiting scroll plate 7*b* and a lubrication groove 21 cut in an fixed scroll plate 7*a*. FIG. 7 is a sectional view taken substantially along a plane passing the center of the axis of rotation Lc of a motor and showing the relation where the orbiting scroll plate 7*b* is in a most deviated position.

Sealing performance of the compressing mechanism which affects the performance of the scroll compressor can be assured in a manner such that flatness of the bed plates of the orbiting scroll plate 7*b* and the fixed scroll plate 7*a* as parts of the compressing mechanism is assured and clearance when the orbiting scroll plate 7*b* and the fixed scroll plate 7*a* are assembled is kept to a value less than a predetermined value by managing the height of spiral wraps by using the bed plates as references.

As a method of forming the spiral wrap on the bed plate, management and finishing methods for forming like a casting material 30 shown in FIG. 9 and for performing by machining will be described.

First, with respect to the management of the casting material 30, when variation in hardness occurs and a portion which is not easily cut exists, since a cutting tool is vibrated by a change in a cutting force at the time of cutting so that a shape accuracy deteriorates, it is necessary to manage so as to keep an absolute value of hardness in a certain range and so as to reduce the variation in hardness.

Secondly, with respect to machining conditions, an example of a cut shape of the orbiting scroll plate 7*b* is shown in FIG. 8. The periphery 71 of the bed plate of the orbiting scroll plate 7*b* has relatively low rigidity as compared with that of the center of the bed plate, so that when a pressing force by the cutting tool acts at the time of the machining, deflection and escape of the material occur. Since flattening is performed in a deflected state, there is a possibility such that the deflection is recovered after the tool was passed and the periphery portion of the bed plate is convexed.

In order to stabilize the production, therefore, the conditions to assure the manufacturing of the casting and machining accuracy are established and a production control so as to prevent the above problems is executed, thereby assuring the performance of the compressor.

According to the machining technique disclosed in the conventional scroll compressor, it is possible to assure the machining accuracy and the performance of the scroll compressor. The following problems, however, occur when costs are lowered by reducing the machining time and the managing time while keeping the performance.

When it is assumed that a processing speed is increased to enhance productivity, the machining by cutting is enhanced and there is a great possibility that the convex shape is formed at the periphery corner 71 of the orbiting scroll plate 7*b* as shown in FIG. 8.

In a change of the casting material 30 shown in FIG. 9, it is assumed a case such that the shape is made more like the cut shape to reduce the amount of cutting of finishing, and further, a cooling rate is raised to shorten a manufacturing time of the casting. In this case, there is a great possibility such that the components are changed in accordance with the cooling rate and a hard layer called a chill layer is formed on the surface contacting a mold.

As described above, the rigidity of the periphery corner 71 of the orbiting scroll plate 7*b* becomes relatively low as compared with that of the center. In machining the material, the low rigidity of the periphery corner 71 and the chill layer formed on the material surface make it difficult to cut it. Because, when the pressing force by the cutting tool acts at the time of machining, the periphery portion is deflected and escaped. As a result, a convex shape is possibly formed since the periphery corner 71 of the orbiting scroll plate 7*b* is not cut or the cutting amount is insufficient.

An influence by the convex shape will be described with reference to FIGS. 10 to 13. FIGS. 10 and 11 show a motion of the orbiting scroll plate 7*b* when the compressor is operated. FIG. 10 is an expanded sectional view of a principal part showing an example of the convex shape of the orbiting scroll plate periphery corner 71, in which an edge of the convex shape is not smooth and the sliding face with the fixed scroll is inclined. FIG. 13 shows an example of a wear 21*c* caused by the convex shape of the periphery corner 71 of the orbiting scroll plate 7*b*.

If the hardness of the convex shape portion of the orbiting scroll plate 7*b* is substantially the same as that of the sliding face of the fixed scroll plate 7*a* and a projection height is large enough for the clearance between the orbiting scroll plate 7*b* and the fixed scroll plate 7*a*, when the convex shape of the periphery corner 71 of the orbiting scroll plate 7*b* enters a lubrication groove 21 formed in the fixed scroll plate 7*a* from the state shown in FIG. 11 and again comes out from the lublication groove 21 during the operation of the compressor, it is anticipated that sliding resistance by collision of the fixed scroll plate 7*a* and the periphery corner 71 of the orbiting scroll plate 7*b* increases.

In the case where the convex shape is higher than the clearance between the orbiting scroll plate 7*b* and the fixed scroll plate 7*a*, in addition to the increase in the sliding force by the collision, a separation force between the bed plate of the orbiting scroll plate 7*b* and the bed plate of the fixed scroll plate 7*a* acts in a separating direction. As a result, it is anticipated that the sealing performance deteriorates and the performance of the scroll compressor consequently deteriorates.

When the convex shape shown in FIG. 12 is harder than the sliding face of the fixed scroll plate 7*a*, the sliding face of the fixed scroll plate 7*a* is cut when the compressor is operated, so that there is a possibility such that the wear 21*c* as shown in FIG. 13 occurs.

Although the above problems don't always occur, measurement management of a huge amount of work with respect to the convex shape has to be performed in a mass production, so that improvement of the productivity cannot be achieved as a whole.

SUMMARY OF THE INVENTION

As shown in FIGS. 2 and 3, a groove is formed so as to have a dimension satisfying the following formula $$O.D > S.D + OFFSET, \text{ and}$$

$$I.D > S.D - OFFSET$$

in a manner such that when a deviation amount of a orbiting scroll at the time of operating a compressor becomes maximum, the periphery corner of a groove cut in a fixed scroll plate is not in contact with the periphery corner of a orbiting scroll plate but is in contact with a sliding face which locates inner than an internal circumference side corner of the groove.

Further, in order to avoid collision with an orbiting scroll supporting member, a corner on the sliding face of the orbiting scroll plate is chamfered to have an obtuse angle as shown in FIG. 5.

The periphery corner of the orbiting scroll plate turns so as not to be in contact with the periphery corner of the groove of the fixed scroll plate but to be in contact with the sliding face positioned inner side than the internal circumference side corner of the groove. Sliding loss and the vibration can be consequently suppressed and it is also effective to assure the sealing performance. An influence by the processing precision of the orbiting scroll plate can be reduced to assure the performance and reliability, so that the reduction of the processing and managing costs can be also realized.

Additionally, an influence by the collision of the periphery corner of the orbiting scroll plate and the periphery side corner of the groove is eliminated and an impact of the collision is also eliminated in a manner such that the inclined portion of the periphery corner of the orbiting scroll plate slides in the inner corner of the groove. Since the groove is not set to be very wide, the size of the sliding face can be sufficiently assured without increasing the slide face, improvement of the sealing performance can be realized and the stable efficiency and the reliability of the sliding portion can be improved.

DETAILED DESCRIPTION OF THE PREFERRED EMBODIMENTS

Figure 1:
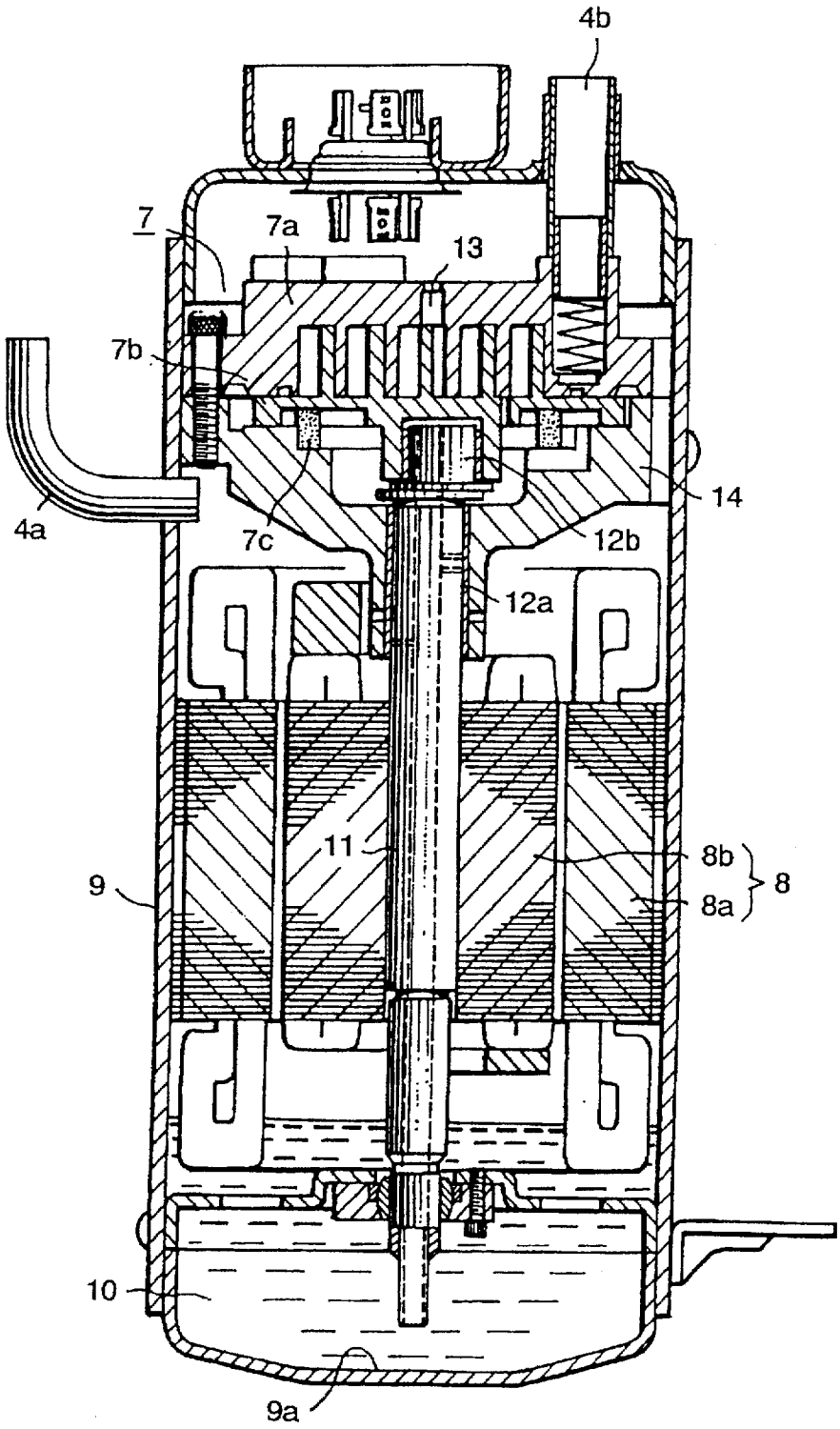
FIG. 1 is a vertical sectional view showing a scroll compressor according to the first embodiment of the present invention.

A first embodiment will be described with reference to FIGS. 1 through 3. In the scroll compressor shown in FIG. 1, a compression mechanism 7 is accommodated in the upper portion of a closed container 9, while a motor 8 is accommodated in the lower portion thereof. Contained in the closed container 9 is a lubricating oil for lubricating sliding portion of the compression mechanism 7.

The compression mechanism 7 has main components, i.e., a fixed scroll 7*a*, an orbiting scroll 7*b*, a frame 14, a crank shaft 11 and an Oldham's ring 7*c*. The motor 8 has a stator 8*a* and a rotor 8*b*. The stator 8*a* is fixed by shrinkage-fitting in the closed container 9. The rotor 8*b* is fixed by press-fitting to the crank shaft 11.

An outer peripheral part of the frame 14 is fixed to the closed container 9 and provided with a bearing for the crank shaft 11. The fixed scroll plate 7*a* is fastened to the frame 14.

The fixed scroll plate 7*a* and the orbiting scroll plate 7*b* respectively have spiral wraps extending from end plates. The respective wraps mesh with each other, thus defining compression chambers.

An eccentric part of the crank shaft 11 is rotatably received in a boss of the orbiting scroll plate 7*b*. A rotation of the scroll plate 7*b* about its own axis is prevented by the Oldham's ring 7*c*, whereby revolving action is given. The arrangement is such that a refrigerant gas sucked from an inlet (not shown) of the fixed scroll plate 7*a* is gradually compressed in the compression chambers with revolutions of the orbiting scroll plate 7*b*.

The lubricating oil 10 is supplied to a bearing part 12*a*, a crank part 12*b*, etc with rotations of the crank shaft 11 connected directly to the rotor 8*b*. The lubricating oil is thereafter discharged through a discharge port 13 and returned again to the closed container bottom part 9*a*. Some of the lubricating oil, however, is atomized due to an influence of stirring or the like of the rotor 8*b* of the motor module. The refrigerant gas enters the compression mechanism 7 from a suction pipe 4*b* and is compressed therein. The compressed gas is exhausted into the closed container 9 from the discharge port 13 and fed together with the atomized lubricating oil to the refrigerating cycle via the discharge pipe 4*a*.

Figure 2:
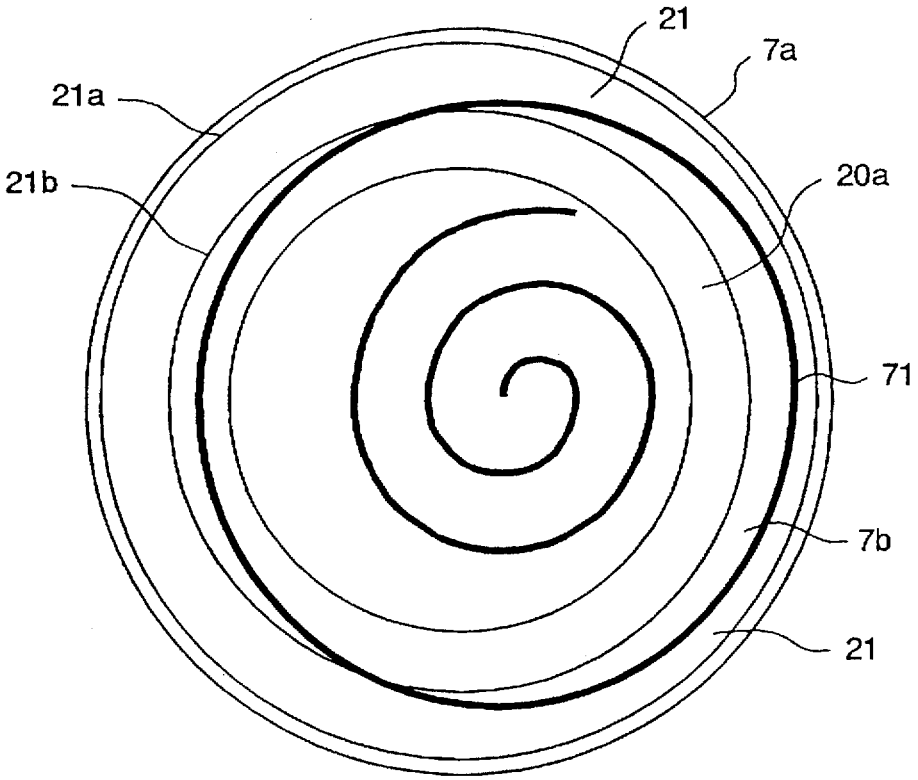
FIG. 2 is a schematic view showing the relationship between a fixed scroll plate 7*a* and an orbiting scroll plate 7*b* of FIG. 1.
Figure 3:
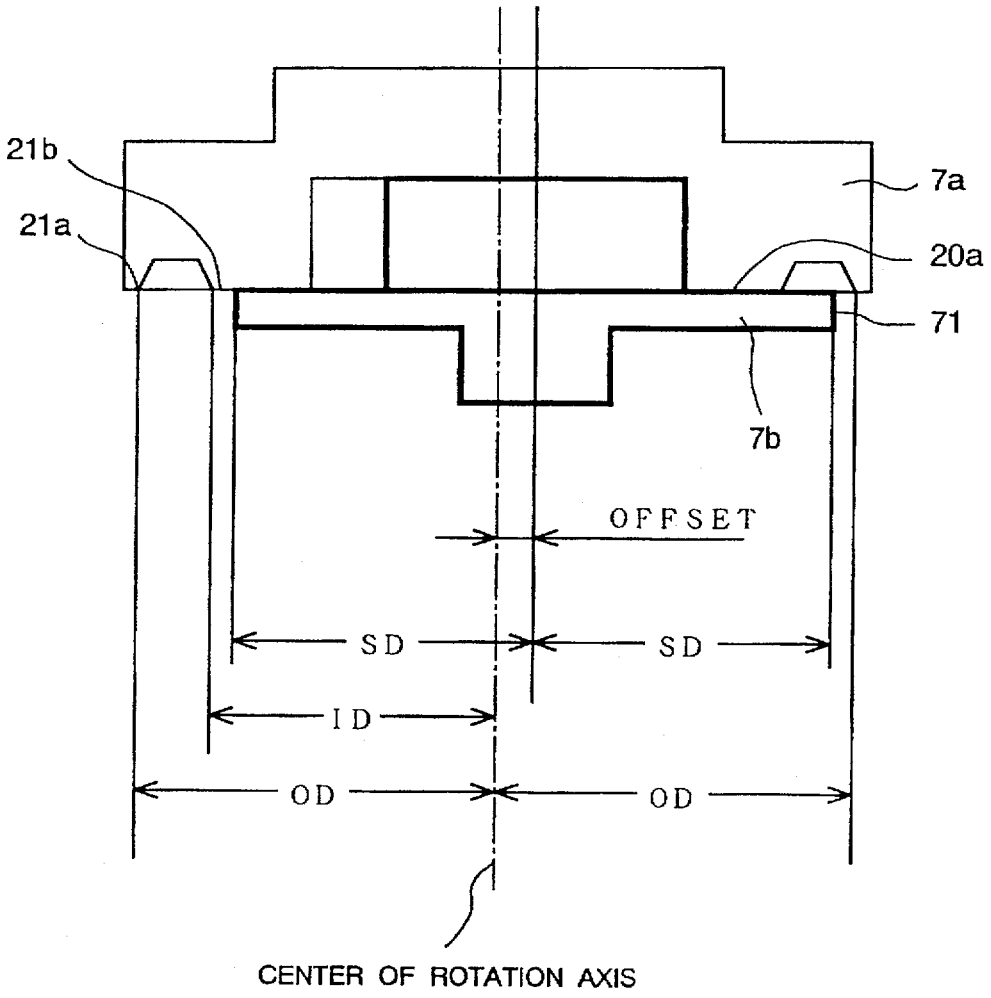
FIG. 3 is a schematic view showing the dimension of the fixed scroll plate and orbiting palate of FIG. 1.

FIG. 2 is an explanatory diagram of a compression mechanism 7 showing a movable range of a periphery corner 71 of a orbiting scroll plate 7*b* and the position relation of an fixed scroll plate groove 21. FIG. 3 is a sectional view along a plane passing the center of the axis of rotation of the motor and showing the relation when the orbiting scroll plate 7*b* is in a most deviated position.

As shown in FIG. 1, in a scroll compressor including the motor section 8 housed in the closed container 9, the compression mechanism 7 comprising the orbiting scroll plate 7*b* having a bed plate driven by the motor section 8 and a spiral wrap integrally formed on the bed plate and a fixed scroll plate 7*a* having a bed plate assembled with the orbiting scroll plate 7*b* and a spiral wrap integrally formed on the bed plate, the relation of (O.D>S.D+OFFSET) and (I.D>S.D−OFFSET) is satisfied, that is, the fixed scroll plate 7*a* has a groove 21 on a sliding face with the orbiting scroll plate 7*b* and the periphery corner 71 of the orbiting scroll plate 7*b* turns between the periphery corner 21*a* of the groove 21 and the sliding face on the inner side (inner diameter side) than the inner corner 21*b* of the groove.

That is, with such a structure, as shown in FIG. 2, an influence by the collision of the periphery corner 71 of the orbiting scroll plate 7b and the periphery side corner 21a of the groove is eliminated and an impact of the collision is also eliminated in a manner such that the inclined portion of the periphery corner 71 of the orbiting scroll plate 7b slides in the inner corner 21b of the groove. Since the groove 21 is not set to be very wide, the size of the sliding face 20a can be sufficiently assured, improvement of the sealing performance can be realized and the stable efficiency and the reliability of the sliding portion can be improved.

Figure 4:
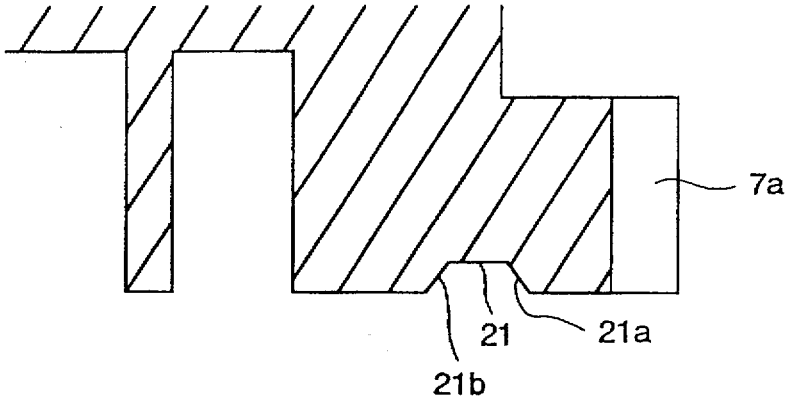
FIG. 4 is a sectional view showing an alternative plan of the first embodiment.

Further, the shape of the fixed scroll plate groove 21 will be described. Although the groove shape can be a rectangle shape in sectional view, a trapezoid shape whose corner angles are dull as shown in FIG. 3 is also considered and an effect more excellent regarding the resistance at the time of the sliding can be derived. A shape obtained by chamfering the corners of the trapezoid shape as shown in FIG. 4 can also obtain a similar effect.

Figure 5:
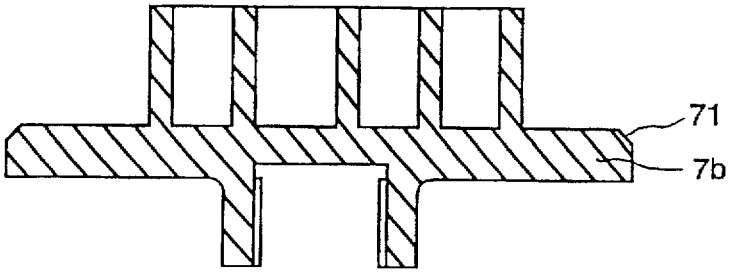
FIG. 5 is a sectional view showing a second embodiment according to the present invention.
Figure 6:
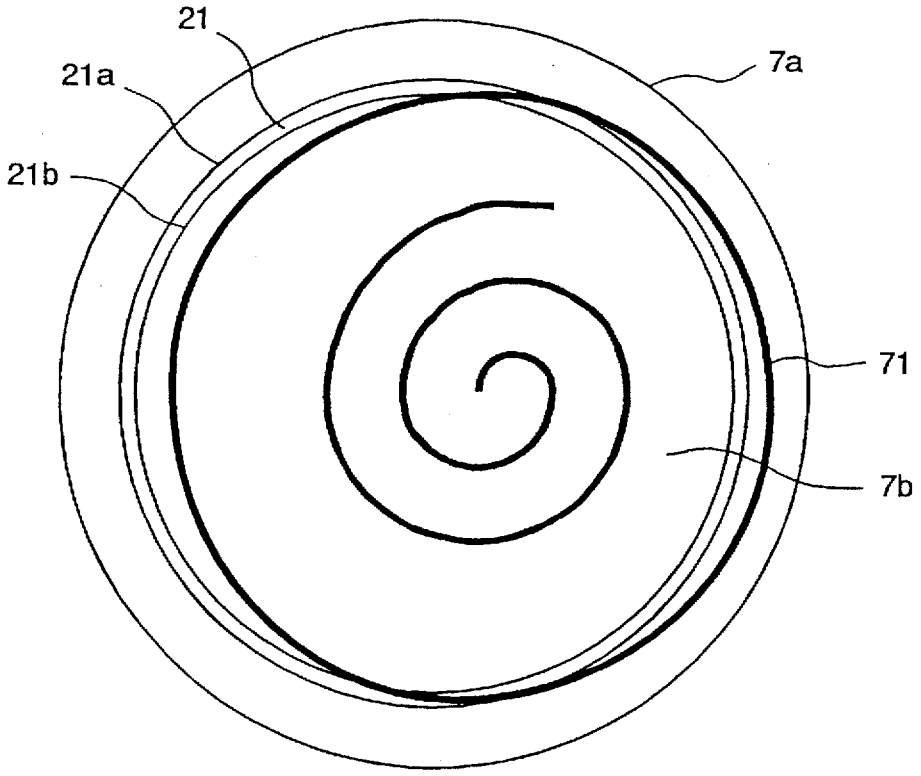
FIG. 6 PRIOR ART
FIG. 6 is a plan view showing the relation between an periphery corner of the orbiting scroll plate and a lubrication groove of a conventional scroll compressor.
Figure 7:
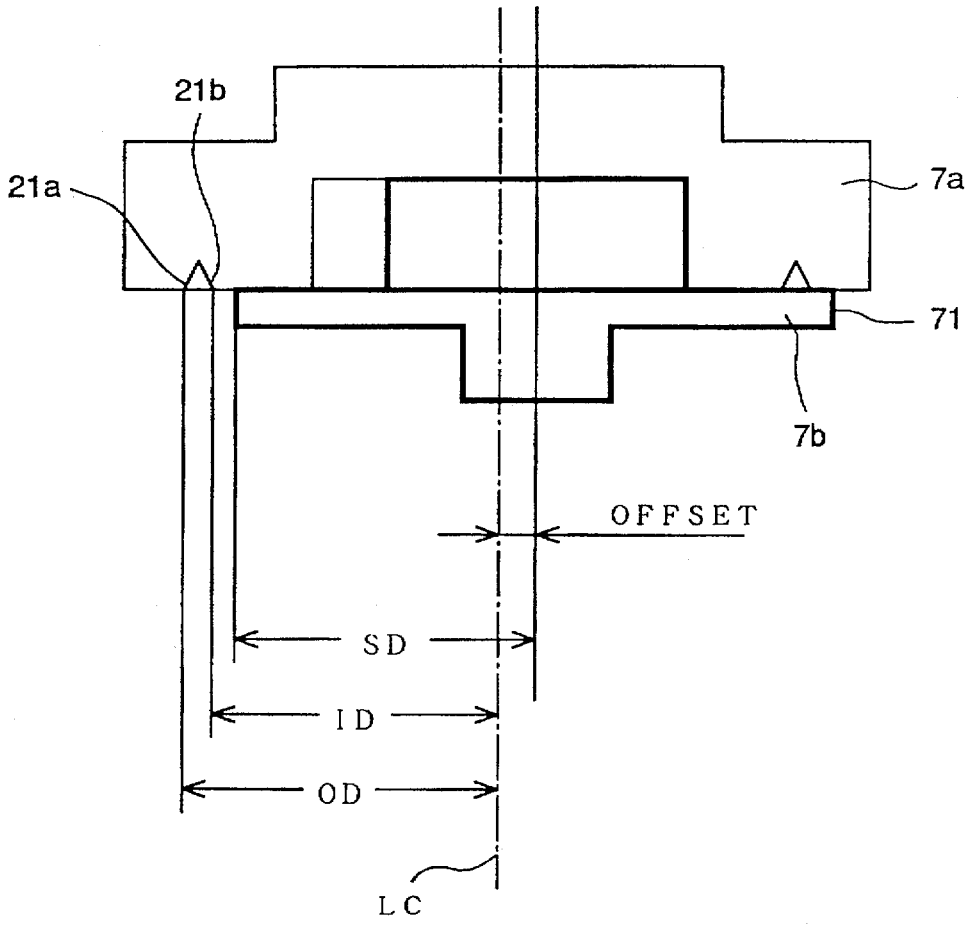
FIG. 7 PRIOR ART
FIG. 7 is a sectional view showing the relation between the periphery corner of the orbiting scroll plate and the lubrication groove of the conventional scroll compressor.
Figure 8:
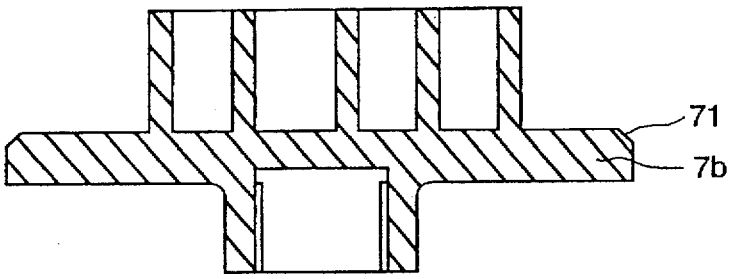
FIG. 8 PRIOR ART
FIG. 8 is a sectional view showing a shape of the known orbiting scroll plate.
Figure 9:
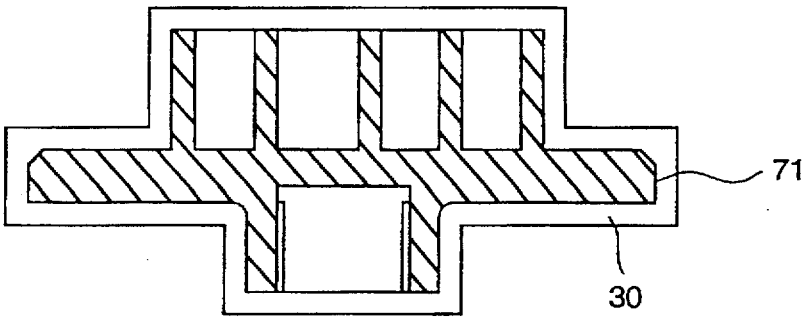
FIG. 9 PRIOR ART
FIG. 9 is a sectional view showing a material shape of the known orbiting scroll plate.
Figure 10:
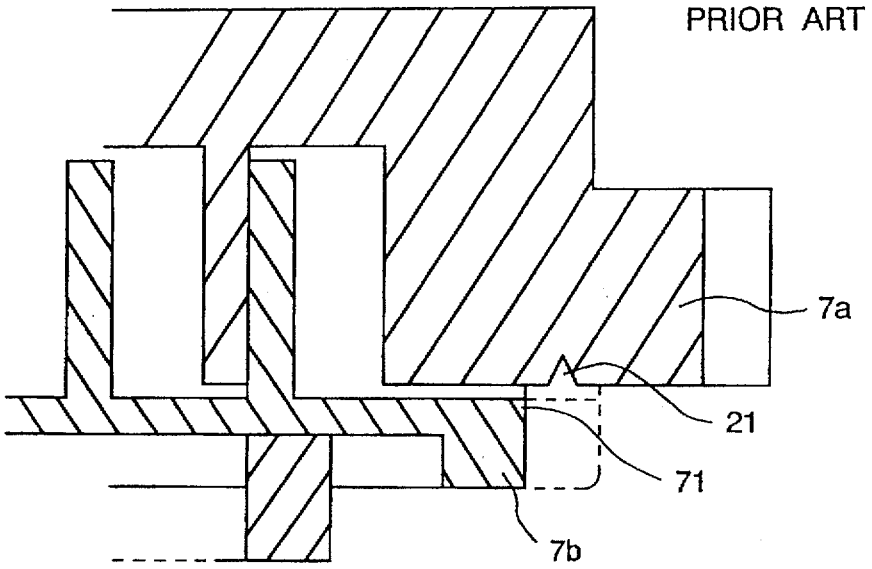
FIG. 10 is a principal part sectional-view showing the relation between the periphery corner of the orbiting scroll plate and the groove in a conventional scroll compressor.
Figure 11:
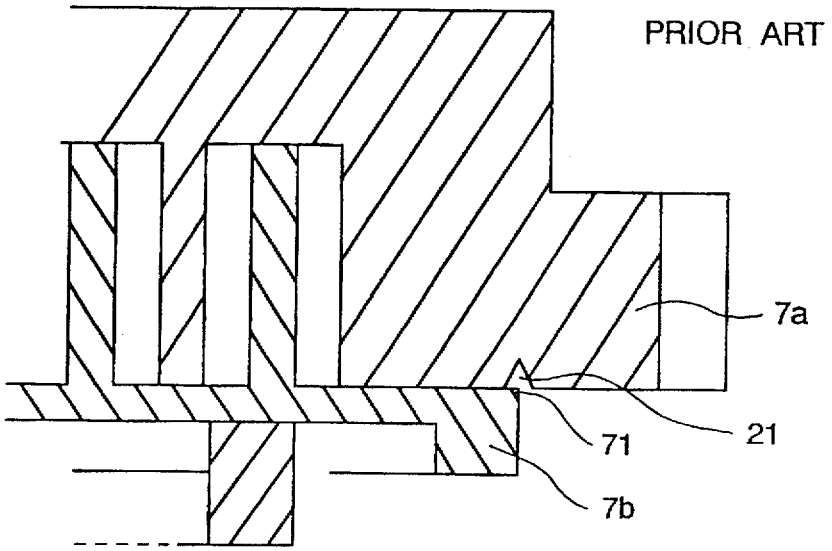
FIG. 11 is a principal part sectional view showing the relation between the periphery corner of the orbiting scroll plate and the groove in the conventional scroll compressor.
Figure 12:
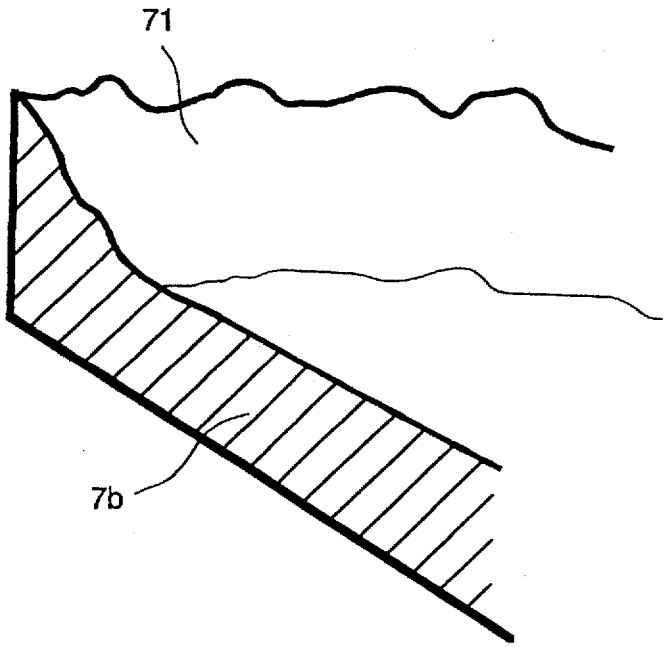
FIG. 12 PRIOR ART
FIG. 12 is a principal part sectional view showing the shape of the periphery corner of the known orbiting scroll plate.
Figure 13:
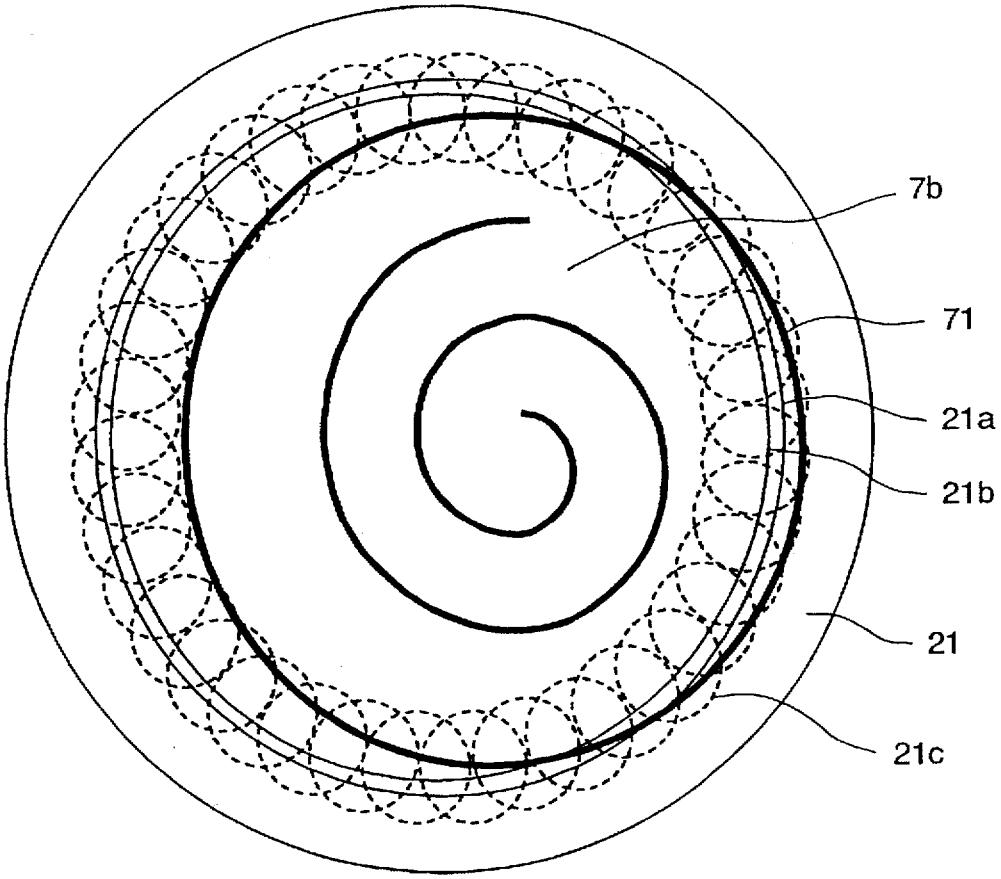
FIG. 13 PRIOR ART
FIG. 13 is a plan view showing a wearing state of portions near a groove of a known fixed scroll plate.

A second embodiment will be described with reference to FIG. 5. FIG. 5 is a diagram showing the shape of the periphery corner 71 of the orbiting scroll plate 7b.

In a scroll compressor comprising a motor section 8 housed in a closed container 9 and a compression mechanism 7 constructed by a orbiting scroll plate 7b having a bed plate driven by the motor section 8 and a spiral wrap integrally formed on the bed plate and an fixed scroll plate 7a having a bed plate which is combined with the orbiting scroll plate 7b and a spiral wrap integrally formed on the bed plate, the fixed scroll plate 7a is provided with an fixed scroll plate groove 21 on a sliding face with the orbiting scroll plate 7b, the periphery corner 71 of the orbiting scroll plate 7b which rotates after passing the fixed scroll plate groove 21 is processed to a taper shape (or round shape) to have an obtuse angle, thereby enabling sliding loss when the orbiting scroll plate 7b is slid to be reduced. In an example where the outer diameter of the orbiting scroll plate 7b is equal to 70 mm, a convex shape of about 2 to 5 micron is formed at a position from 0.5 mm from the periphery. By performing a chamfering of C: 1.0 in a range of 1 mm from the periphery, the sliding loss with the fixed scroll plate groove 21 and an influence on leakage due to a fact such that the orbiting scroll plate 7b is away from the fixed scroll plate 7a by an amount corresponding to the convex shape by the projection can be reduced. It is also similarly effective that the deflection upon process of the periphery corner 71 of the orbiting scroll plate 7b is foreseen and the periphery is cut so as to be lower than the center.

Consequently, the stable efficiency, reliability of the sliding portion can be improved by the improvement of the sealing performance of the orbiting scroll plate 7b and the fixed scroll plate 7a and the process and management costs can be lowered, so that the cheap, reliable, and efficient scroll compressor can be realized.

We claim:

1. A scroll compressor comprising:

a closed container;

a motor section housed in the closed container;

a fixed scroll plate having a bed plate and a spiral wrap integrally formed on the bed plate and extending from the bed plate; and an orbiting scroll plate driven by said motor section and having a bed plate assembled with said orbiting scroll plate and a spiral wrap integrally formed on the bed plate and extending from the bed plate;

wherein the bed plate of said orbiting scroll plate is assembled so as to offset the center thereof for the center of the axis of said fixed scroll plate in a radius direction of a turn, and a ring-shaped groove concentric with the axis of said fixed scroll plate is formed in a sliding face of said fixed scroll plate, and wherein a periphery corner of said orbiting scroll plate is disposed so as to orbit in a range between a position inwardly of an outer circumference side corner of the groove and a position of the sliding face inwardly of the internal circumference side corner of the groove.

2. A scroll compressor according to claim 1, wherein the periphery corner of the orbiting scroll plate is formed to have an obtuse angle.

* * * * *